US006186594B1

(12) United States Patent
Valiquette et al.

(10) Patent No.: US 6,186,594 B1
(45) Date of Patent: Feb. 13, 2001

(54) FLEXIBLE CONTOUR WHEELCHAIR BACKREST

(75) Inventors: Claude Valiquette, L'Île Bizard; Frédéric Parent, Valleyfield; Jean Dansereau, Ste-Thérèse, all of (CA)

(73) Assignee: Corporation de l'ecole Polytechnique, Montreal (CA)

( * ) Notice: Under 35 U.S.C. 154(b), the term of this patent shall be extended for 0 days.

(21) Appl. No.: 09/056,397

(22) Filed: Apr. 7, 1998

(51) Int. Cl.[7] ..... A47C 3/025

(52) U.S. Cl. ..... 297/284.4; 297/284.1

(58) Field of Search ..... 397/DIG. 4, 440.21, 397/440.24, 452.4, 452.33, 452.63, 284.1, 284.2, 284.4, 284.9, 353, 354.1

(56) References Cited

U.S. PATENT DOCUMENTS

| | | | | |
|---|---|---|---|---|
| 1,508,859 | * | 9/1924 | Schoenhoff . | |
| 3,990,745 | | 11/1976 | Rodaway | 297/444 |
| 4,541,670 | | 9/1985 | Morgenstern et al. | 297/284 |
| 4,697,484 | | 10/1987 | Hattori et al. . | |
| 4,798,414 | | 1/1989 | Hughes | 297/284 |
| 4,810,033 | | 3/1989 | Kemmann | 297/284 |
| 4,810,034 | | 3/1989 | Beier | 297/284 |
| 4,883,320 | * | 11/1989 | Izumida et al. . | |
| 4,925,242 | | 5/1990 | Harris et al. | 297/284 |
| 4,981,325 | | 1/1991 | Zacharkow | 297/284 |
| 5,062,677 | | 11/1991 | Jay et al. | 297/444 |
| 5,211,446 | | 5/1993 | Jay et al. | 297/444 |
| 5,364,162 | | 11/1994 | Bar et al. | 297/284.8 |
| 5,364,165 | | 11/1994 | Okamoto | 297/364 |
| 5,437,498 | * | 8/1995 | Waelde . | |
| 5,547,251 | | 8/1996 | Axelson | 297/284.5 |
| 5,549,357 | | 8/1996 | Counts et al. | 297/354.13 |
| 5,573,302 | | 11/1996 | Harrison et al. | 297/230.14 |
| 5,667,274 | * | 9/1997 | Blackman . | |
| 5,685,606 | * | 11/1997 | Lance . | |

FOREIGN PATENT DOCUMENTS

| | | | | |
|---|---|---|---|---|
| 753914 | * | 3/1967 | (CA) | 297/284.4 |
| 2721539 | * | 11/1978 | (DE) | 297/284.9 |
| 401086 | * | 12/1990 | (EP) | 297/284.9 |
| 1373267 | * | 8/1964 | (FR) | 297/452.34 |
| 526572 | * | 9/1940 | (GB) | 297/284.4 |
| WO 96/25868 | | 8/1996 | (WO) . | |

OTHER PUBLICATIONS

"Webbed Elastic for Postural Seating in Cases of Severe Deformity" D.A. O'Rouke, 6th Annual Conference on Rehabilitation Engineering, 1983, pp. 206–208.

"Towards an Economical Postural Seating System Using an Adjustable Mesh" F.Ginpil, M. Milner, M. Rang, Proc. of the 2nd Int'l Conf. on Rehabilitation Engineering, 1984, pp. 489–190.

(List continued on next page.)

*Primary Examiner*—Milton Nelson, Jr.
(74) *Attorney, Agent, or Firm*—Merchant & Gould P.C.

(57) ABSTRACT

The flexible contour wheelchair backrest comprises two side posts, and a flexible backrest body extending between the two side posts. The flexible backrest body comprises a plurality of transversally extending and vertically spaced apart flexible straps each interconnecting the two side posts and each having an adjustable length, and a plurality of substantially stiff and malleable stays intersecting at least one of the flexible straps at right angle. Each side post defines an elongated curved front face for receiving the flexible backrest body. This elongated curved front face has a forwardly bulging section for inducing a depth dimension to the flexible backrest body to fit the posterior lateral contour of a user's back and thereby provide lateral support to the user's trunk. A mechanism is used to adjust the distance between the forwardly bulging sections of the elongated curved front faces. In operation, the contour of the backrest body can be adapted to the posterior lateral contour of a user's back by adjusting the distance between the forwardly bulging sections, the length of the straps, and the shape of the stays.

29 Claims, 7 Drawing Sheets

OTHER PUBLICATIONS

"Inflatable Lumbar Support Incorporated Within a Custom Backrest" R.Rego, L. McEntyre, D. LeFeber, R. FitzGerald, Resna 12th Annual Conference, 1989, pp. 460–461.

"Clinical and Research Methodologies for Functional Changes in Seating Systems" P.W. Axelson, D.A. Chesney, International Seating Symposium, 1996, pp. 81–84.

"A Simple Trunk Support Solution for Active Manual Wheelchair Users" C. Stout, Rehabilitation Engineer, pp. 243–246.

"Clinical Considerations in the Selection of Common Commercial Backs" J. Stone, BSR (PT,OT) pp. 133–137.

"New HiBack Wheelchair Backrest System" ROHO Incorporated, 1991, Pamphlet, 2 pages.

"Ulti–Mate Air Back" Special Health Systems, Seating Specialists, Pamphlet, 4 pages.

"Pindot® Paxbac™" Pamphlet, 1 page.

Action A–T, Pamphlet, 1 page.

A.F. Bergen, J. Presperin and T. Tallman; "Positioning for functions: Wheelchairs and Other Assistive Technologies"; *Vallhalla Rehabilitation Publications Ltd;* 1990; pp. 22–24 and 36–37.

D. Zacharkow; "Wheelchair Posture and Pressure Sores"; Springfield, Ill.; 1984; pp. v, 6–9.

"Clinical Methodologies for Measuring Changes in Sitting Posture with Function" J.A. Zollard, D. Chesney, P.Alexson, International Seating Symposium, 1994, pp. 97–108.

"Immediate Improvements in Wheelchair Mobility and Comfort with Use of the Adjustable Back Support Shaping System" D.A. Chesney, L.Hsu, W.Wright, P.W. Axelson, Resna 1995, 3 pages.

"Back Support Shaping System" J.A. Zollars, P. Axelson, Beneficial Desings, Inc., RBDI Back Support Info Sheet, 1995, pp. 0–4.

Claude Valiquette, Jean Audet; "Pushing the Limits of the Sling Concept: The Contoured Sling Backrest"; *Canadian Seating and mobility conference;* 1992; Toronto.

Jean Anne Zollars and Peter Axelson; "The Back Support Shaping System: An Alternative for Persons using Wheelchairs with Sling Back Upholstery"; *Proceedings of the 16th Annual RESNA Conference, Las Vegas, Resna Press;* Jun. 12–17, 1993; pp. 274–276.

Michael Harms; "Effects of Wheelchair Design on Posture and Comfort of Users"; *Physiotherapy;* May 1990; vol. 76, No. 5, pp. 266–271.

* cited by examiner

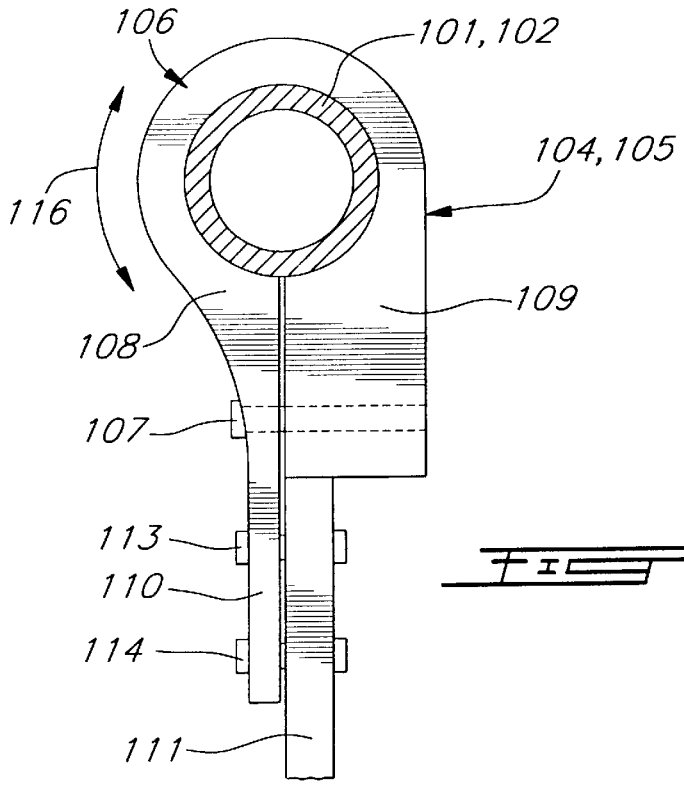
FIG. 8
FIG. 9
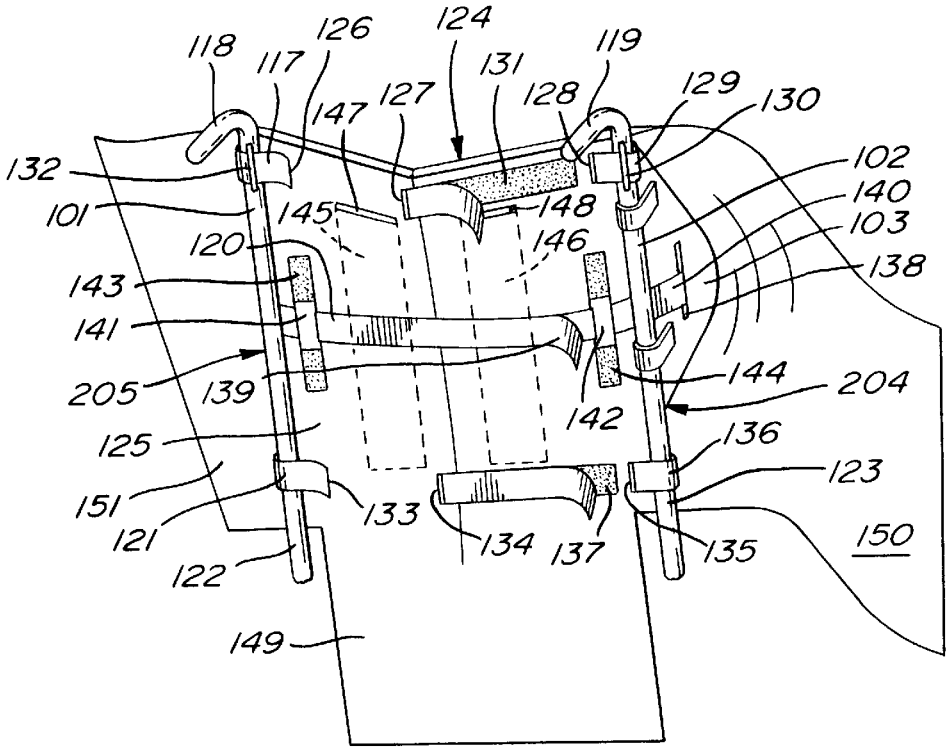

FLEXIBLE CONTOUR WHEELCHAIR BACKREST

BACKGROUND OF THE INVENTION

1. Field of the Invention

The present invention relates to a flexible backrest, in particular but not exclusively a wheelchair backrest, having a contour that can be easily adjusted to the morphology and anthropometry of a user's back.

2. Brief Description of the Prior Art

Manual wheelchairs usually come with conventional sling backrests. Originally, this type of backrest was designed to enable easy folding of the wheelchair. However, some studies have demonstrated that prolonged use thereof may negatively affect user's posture, comfort, function and health (Zollars, J. & Axelson, P. (1993) "*The back support shaping system: an alternative for persons using wheelchairs with sling upholstery*", Proceedings of the 16$^{th}$ Annual RESNA Conference, Las Vegas, RESNA Press, 274–276; Harms, M. (1990) "*Effects of wheelchair design on posture and comfort of users*", Physiotherapy, 76, 5, 266–271; Bergen, A. & Presperin, J. (1990), "*Positioning for functions: wheelchairs and other assistive technologies*", Valhalla Rehabilitation Publications Ltd; and Zacharkow, D. (1984), "*Wheelchair posture and pressure sores*", Springfield, Ill.). In fact, they may cause the spine to curve into a kyphotic geometry and produce a posterior tilting of the pelvis, which can lead to back and neck pain, and even to long-term deformities of the spine and pelvis. Moreover, conventional sling backrests do not provide sufficient lateral trunk support to prevent, manage or correct trunk alignment problems.

Considering these problems, the development of special seating for people with disabilities become important. The technology in seating has rapidly evolved around cushions or combination of rigid interfaces and cushions with great results. There is a general consensus that, from a posture standpoint, they offer some of the best solutions (Valiquette, C. & Audet, J. (1992) "*Pushing the limits of the sling concept: the contoured sling backrest*" Canadian seating and mobility conference, Toronto). Unfortunately, the use of cushions deprives many wheelchair users of the advantages of the sling backrests such as foldability, light weight, low cost and simplicity (Valiquette, C. & Audet J. (1992), "*Pushing the limits of the sling concept: the contoured sling backrest*", Canadian seating and mobility conference, Toronto; and Zollars J. & Axelson P. (1993), "*The back support shaping system: an alternative for person using wheelchairs with sling upholstery*", Proceedings of the 16$^{th}$ Annual RESNA Conference, Las Vegas: RESNA Press, 274–276).

In this way, adjustable-tension back upholstery was introduced on the market to preserve the sling backrests characteristics while improving the user's posture and comfort. Adjustable-tension back upholstery are foldable and can accommodate lumbar lordosis or kyphosis by the use of adjustable straps. In spite of the improvement, they often give poor lateral trunk support and some adjustments are still missing to maintain neutral pelvic position and lumbar lordosis. Given this context, the conception of a new backrest for wheelchair is worthwhile.

OBJECTS OF THE INVENTION

An object of the present invention is therefore to provide a flexible contour backrest, in particular but not exclusively a wheelchair backrest, which overcomes the above mentioned drawbacks of the prior art.

Another object of the present invention is to provide a flexible contour backrest, in particular but not exclusively a wheelchair backrest, having a contour that can be easily adjusted to fit a plurality of users' back contours in view of (a) suitably supporting the back of these users and (b) improving lateral trunk support.

SUMMARY OF THE INVENTION

More specifically, in accordance with the present invention, there is provided a flexible contour backrest comprising two side posts, and a flexible backrest body extending between the two side posts. The flexible backrest body comprises a plurality of transversally extending and vertically spaced apart flexible straps each interconnecting the two side posts and each having an adjustable length, and a plurality of substantially stiff stays intersecting at least one of the flexible straps. In operation, the contour of the backrest body can be adjusted to the contour of a user's back by adjusting the length of the straps and the shape of the stays.

Also in accordance with the present invention, in a flexible contour backrest comprising two side posts, and a flexible backrest body extending between the two side posts and including two opposite sides attached to the two side posts, respectively, the improvement comprises an elongated curved front face of each side post for receiving the two opposite sides of the flexible backrest body, respectively. This elongated curved front face of each side post has a forwardly bulging section for inducing a depth dimension to the flexible backrest body to fit the posterior lateral contour of a user's back and thereby providing lateral support to the user's trunk.

The present invention further relates to a flexible contour backrest comprising two side posts each comprising an elongated curved front face, and a flexible backrest body extending between the elongated curved front faces of the two side posts. The flexible backrest body comprises (a) a plurality of transversally extending and vertically spaced apart flexible straps each interconnecting the two side posts with elongated curved front faces, and each having an adjustable length, and (b) a plurality of substantially stiff stays intersecting at least one of the flexible straps.

In accordance with preferred embodiments:

- the substantially stiff stays are malleable to facilitate adjustment of their shape;
- the plurality of transversally extending and vertically spaced apart flexible straps comprises an upper strap, a lower strap, and an intermediate strap situated between the upper and lower strap, and the flexible contour backrest further comprises means for adjusting a vertical position of the intermediate strap on the two side posts;
- the transversally extending and vertically spaced apart flexible straps are generally perpendicular to the two side posts, and the substantially stiff stays are generally perpendicular to these straps;
- the flexible backrest body comprises elongated pockets for receiving the substantially stiff stays;
- the two side posts are mounted on a chair frame, and the flexible contour backrest further comprises mechanical means for adjusting the vertical position of the two side posts on the chair frame; and
- the flexible contour backrest comprises mechanical means for varying the distance between the forwardly bulging sections of the elongated curved front faces of the two side posts, in order to adapt the distance between said forwardly bulging sections to the width of the user's trunk.

In accordance with a first alternative embodiment:

the two side posts each comprise an elongated member defining a two-dimensional or three-dimensional curve and having a substantially straight lower end mounted to a chair frame, this substantially straight lower end having a longitudinal geometrical axis;

the mechanical means comprises means for rotating the substantially straight lower end of the curved elongated member on the chair frame about the longitudinal geometrical axis, and means for locking the substantially straight lower end of the curved elongated member on the chair frame in a plurality of different angular positions about the longitudinal geometrical axis; and the mechanical means further comprises means for axially moving the substantially straight lower end of the curved elongated member about the chair frame and means for locking the substantially straight lower end of the curved elongated member on the chair frame in a plurality of different axial positions.

In accordance with a second alternative embodiment:

the two side posts each comprise an elongated member, and a contour member mounted on the elongated member to define the elongated curved front face of the side post;

the mechanical means comprises means for rotating the contour member about the elongated member, and means for locking the contour member in a plurality of different angular positions about the elongated member; and the mechanical means further comprises means for moving the contour member longitudinally on the elongated member, and means for locking the contour member in a plurality of different positions along the elongated member.

In operation, the shape of the flexible contour backrest according to the invention can be adjusted to the morphology and anthropometry of the posterior lateral contour of the user's back by adjusting:

the length of the upper, lower and intermediate straps;

the shape of the stays;

the vertical position of the intermediate strap and eventually the vertical position of the upper and lower straps on the two side posts;

the angular position of the substantially straight lower end of the curved elongated member on the chair frame about the longitudinal geometrical axis;

the axial position of the substantially straight lower end of the curved elongated member about the chair frame;

the angular position of the contour members about the elongated members; and/or the position of the contour members along the elongated members.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 8 is a cross sectional plan view of a mechanism for adjusting the angular position of the contour member of FIG. 7, taken along line 8—8 of FIG. 6; and FIG. 9 is a rear perspective view of a flexible backrest body of the second embodiment of the flexible contour backrest according to the invention.

DETAILED DESCRIPTION OF THE PREFERRED EMBODIMENTS

Although the preferred embodiments of the flexible contour backrest according to the present invention will be described hereinafter with reference to the backrest of a wheelchair, it should be kept in mind that the present invention also applies to the backrest of other types of chairs, or to the backrest of any other apparatuses.

Figure 1:
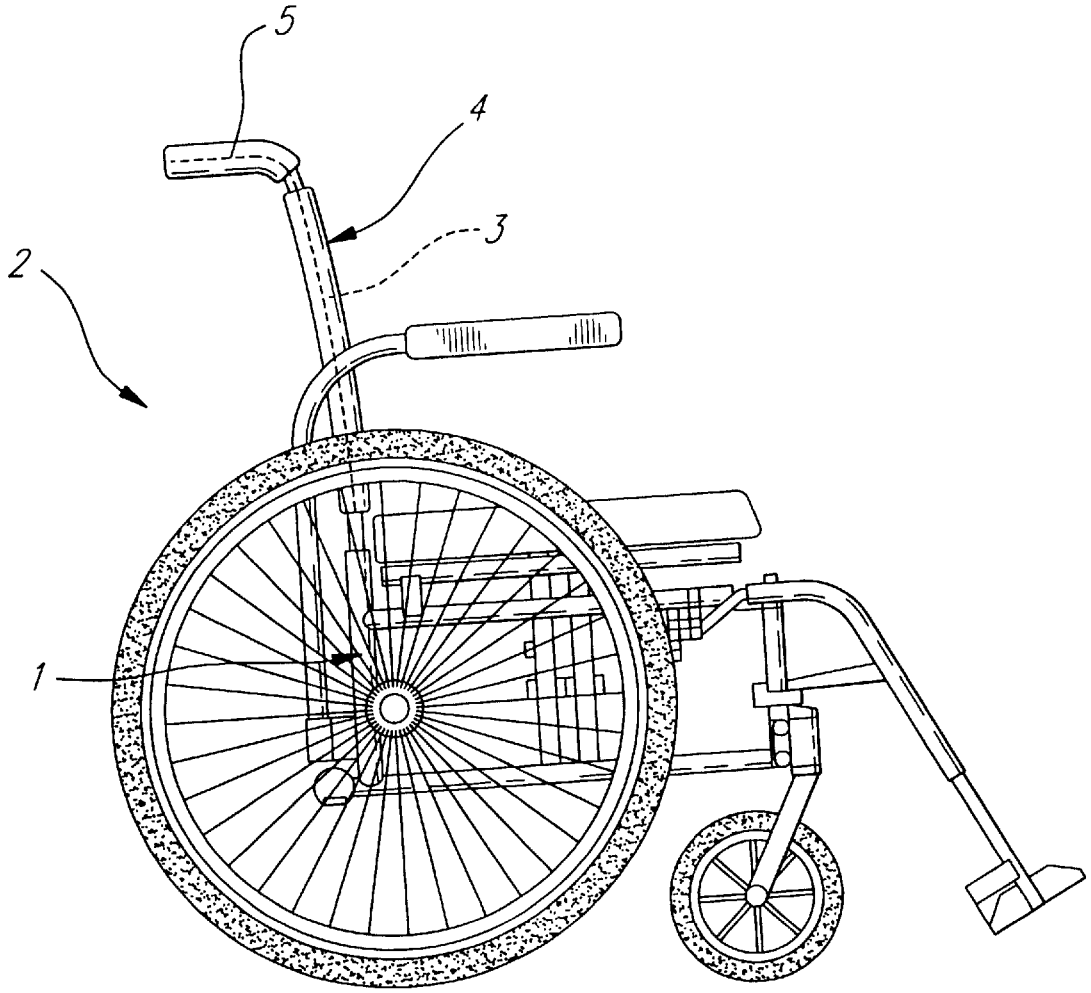
FIG. 1 (PRIOR ART)
FIG. 1, which is labelled as "prior art", is a side elevational view of a conventional wheelchair.

FIG. 1 illustrates an example of conventional wheelchair 2 comprising on both sides thereof a generally vertical, one-piece rear tubular post such as 1. The upper portions of the rear tubular posts such as 1 which receive side posts (often referred to as "back post" in the literature) such as 3 of the backrest 4. The side posts such as 3 can be either vertical or slightly inclined rearwardly as shown in FIG. 1. The upper end of the side posts such as 3 are bent rearwardly to form conventional wheelchair handles such as 5.

Conventional wheelchairs are well known to those of ordinary skill in the art and, accordingly, do not need to be further described in the present specification.

In accordance with a first preferred embodiment of the present invention, the side posts of the flexible contour backrest are made of curvilinear and rotatable tubular members.

Figure 2:
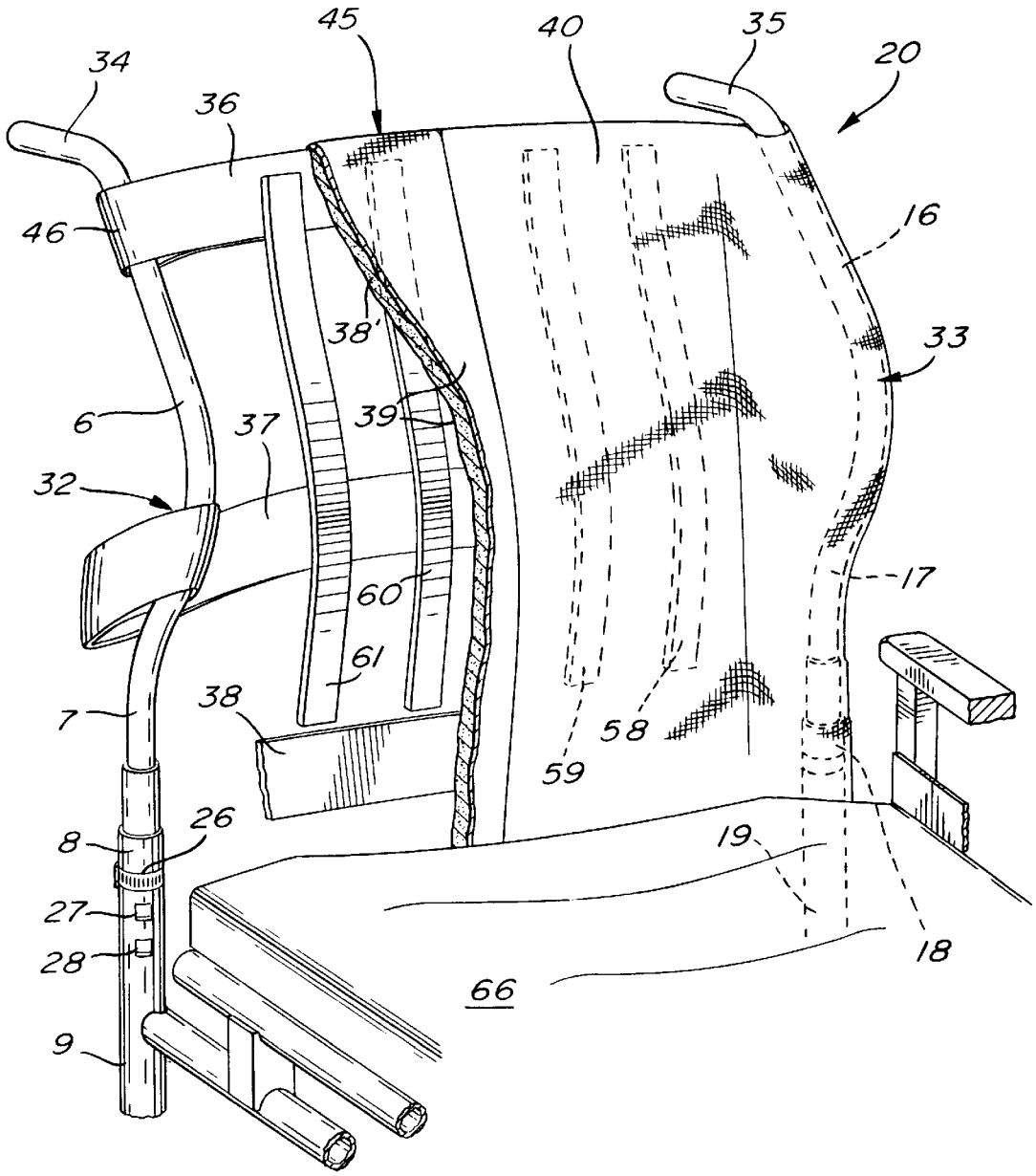
FIG. 2 is a front, perspective view, partially cut away, of a first embodiment of the flexible contour backrest according to the invention.

More specifically, as illustrated in FIG. 2, the vertical rear tubular posts of a wheelchair comprises upper and lower sections. The upper sections of the generally vertical rear tubular posts form the side posts 6 and 16, respectively, on both sides of the flexible contour backrest 20. Each side post 6, 16 is formed of an elongate curvilinear and rotatable tubular member having a substantially straight lower end 7, 17 rotatably mounted in the upper end 8, 18 of the lower section 9, 19 of the generally vertical rear tubular post of the wheelchair.

Figure 3:
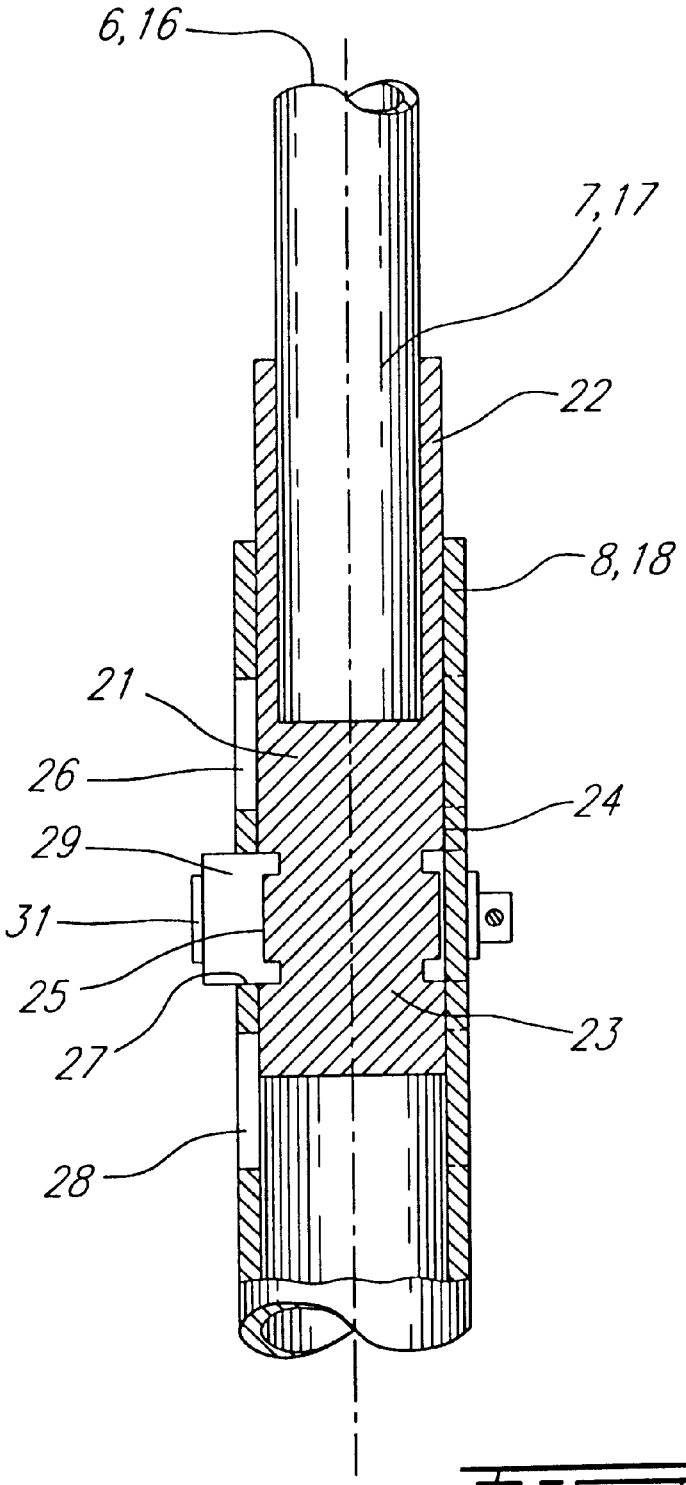
FIG. 3 is an elevational, cross sectional view of a mechanism for rotating the substantially straight lower ends of side posts of the flexible contour backrest of FIG. 2 about their longitudinal geometrical axis.

A preferred embodiment of the mechanism for rotatably mounting the substantially straight lower end 7,17 of the side post 6, 16 in the upper end 8, 18 of the lower portion 9, 19 of the generally vertical rear tubular post is illustrated in FIG. 3. The lower tubular end 7, 17 is first mounted, for example press-fit in a tubular upper section 22 of a cylindrical member 21. The lower portion 23 of the cylindrical member 21 has an outer cylindrical surface 24 formed with an annular groove 25. The cross section of the annular groove 25 is shown in FIG. 3.

The upper end 8, 18 is provided with a series of radial square holes 26, 27 and 28. Each square hole 26, 27 or 28 is capable of receiving a block 29 having a toothed face that snugly fits into the annular groove 25. As an example, FIG. 3 shows the block 29 inserted in the radial hole 27 and having its toothed face snugly fitted into the annular groove 25. A collar 31 is tightened on the upper end 8, 18 over the block 29 to complete the assembly.

Those of ordinary skill in the art will appreciate that the toothed face of block 29 snugly fitting into the annular groove 25 will enable, when the collar 31 is untightened, to rotate the substantially straight lower end 7, 17 of the side post 6, 16 about the longitudinal, geometrical axis of this substantially straight lower end 7, 17. The toothed face of the block 29 snugly fitting into the annular groove 25 will also prevent axial movement of the substantially straight lower end 7, 17 in the upper end 8, 18 of the lower section 9, 19. When tightened the collar 31 will prevent both rotation of the substantially straight lower end 7, 17 about its longitudinal geometrical axis and axial movement of the substantially straight lower end 7, 17 in the upper end 8, 18.

Referring back to FIG. 2 of the appended drawings, the substantially straight lower end 7, 17 of the side post 6, 16 is generally straight and parallel to the lower post section 9, 19. The side post 6, 16 is then successively bent forwardly and rearwardly to produce a forwardly bulging section 32, 33. Finally, the upper free end of the side post 6, 16 is bent rearwardly to form a handle 34, 35. A preferred non limitative embodiment of the side posts 6 and 16 is given in FIG. 4, in which the dimensions, lengths, radius of curvature, etc., are given in inches. The external diameter of the tubular members forming the side posts 6 and 16 is ¾ inch.

Figure 4:
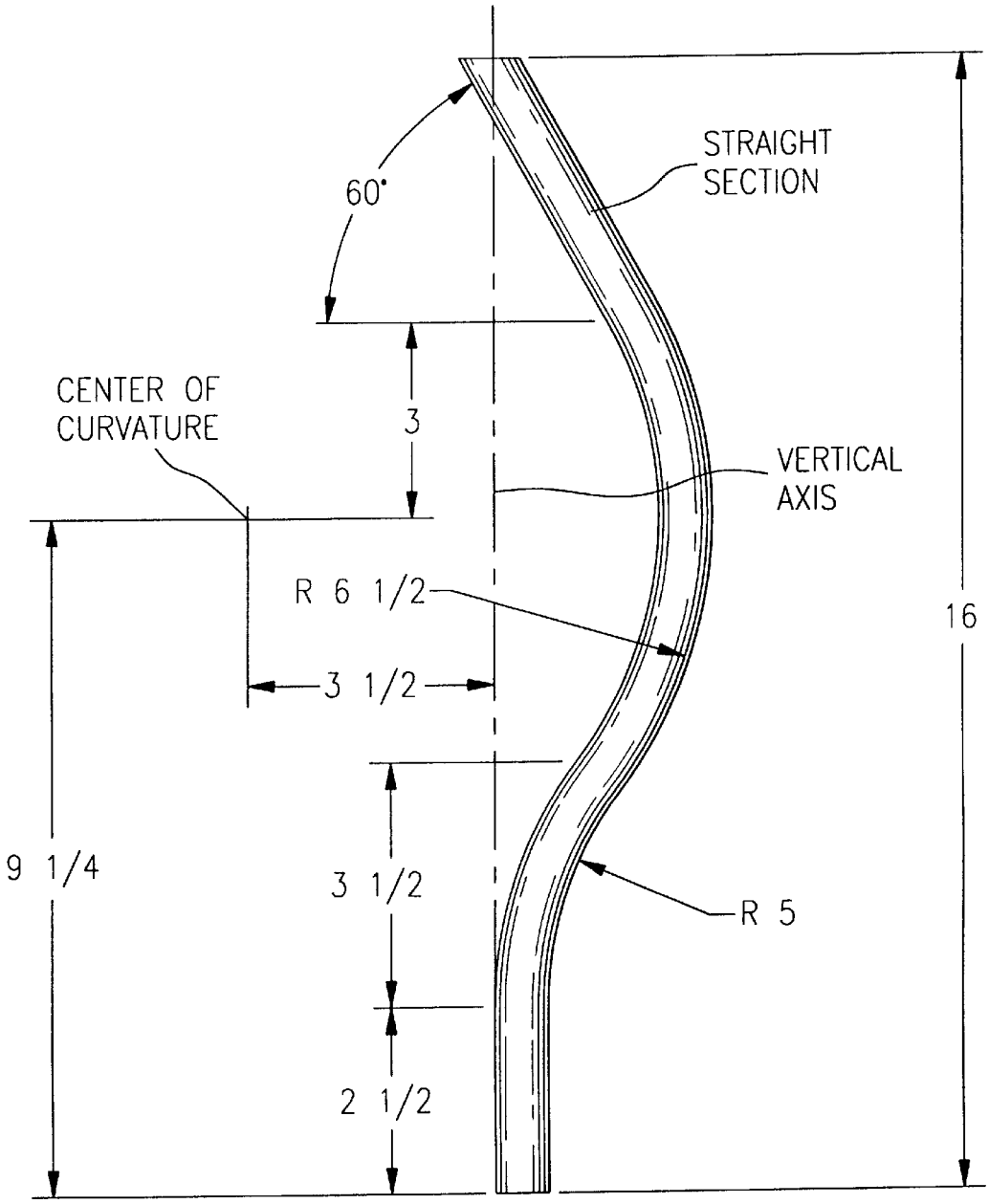
FIG. 4 is a side elevational view of the side posts of the first embodiment of the flexible contour backrest according to the invention.

Although FIG. 4 presents a preferred embodiment in which the side posts are formed with a two-dimensional curve, it is within the scope of the present invention to provide side posts presenting a three-dimensional curve.

The above described rotation of the substantially straight lower end 7, 17 about its longitudinal geometrical axis will enable adjustment of the angular position of the forwardly bulging section 32, 33 in relation to the requirements of the morphology and anthropometry of a user's back, in particular in relation to the width of the user's trunk.

The flexible contour backrest comprises, as illustrated in FIG. 2, a flexible backrest body 45 extending between the two side posts 6 and 16. This flexible backrest body 45 comprises an upper strap 36 extending between the upper ends of the side posts 6 and 16. The flexible backrest body 45 further comprises an intermediate strap 37 and a lower strap 38. The lower strap 38 extends between the substantially straight lower ends 7 and 17 of the side posts 6 and 16. Regarding the intermediate strap 37, it extends, in the preferred embodiment illustrated in FIG. 2, between the forwardly bulging sections 32 and 33 of the side posts 6 and 16.

The flexible backrest body 45 further comprises a layer of foam 38' covered by an envelope of nylon fabric 39. In a preferred embodiment, the central region of the layer of foam is ½ inch thick. The lateral regions of the layer of foam is 1 inch thick to prevent any discomfort caused to the user's trunk by the side posts. As can be seen in FIG. 2, the front layer of nylon fabric forms the front face 40 of the backrest body 45. The rear face 41 of the backrest body 45 is illustrated in FIG. 5.

Figure 5:
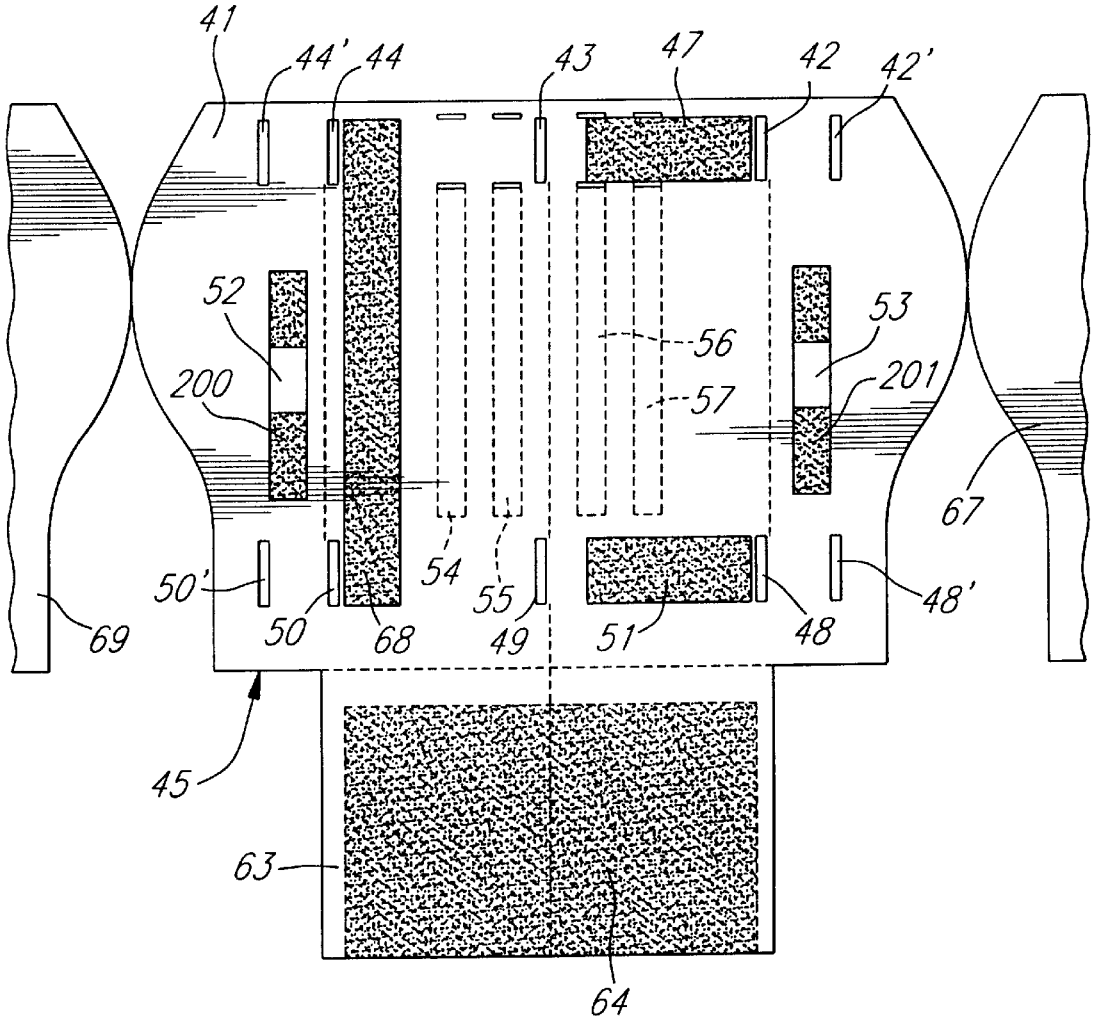
FIG. 5 is a rear elevational view of a flexible contour backrest body of the first embodiment of the flexible contour backrest according to the invention.

Referring now to FIG. 5 of the appended drawings, the nylon fabric comprises on the rear face 41 a series of five upper slits 42', 42, 43, 44 and 44' in the nylon fabric on the back of the flexible backrest body 45. A first end of the upper strap 36 is sewed inside the flexible backrest body 45. A second end of the upper strap 36 exits the flexible backrest body 45 through slit 42, and is then passed around the upper end of the side post 6, below the handle 34, to form a loop 46. Post 6 is provided with a strap holding element (similar to elements 130 and 132 of FIG. 9) to prevent the loop 46 from sliding downwardly on that side post 6, and thereby hold the flexible backrest body 45 in stable vertical position on that side post 6.

The second end of the upper strap 36 successively enters slit 42' and exits slit 44'. The strap 36 is then passed around side post 16 below handle 35, and then successively enters slit 44 and exits slit 43. Finally, a Velcro (trademark) fastener provided on the second end of the strap 36 is attached to a complementary Velcro (trademark) fastener 47 fixed on the rear face 41 of the backrest body 45. Again, post 16 is provided with a strap holding element (similar to elements 130 and 132 of FIG. 9) to prevent the upper strap 36 from sliding downwardly on that side post 16, and thereby hold the backrest body 45 in stable vertical position on the side post 16.

As also illustrated in FIG. 5 of the appended drawings, the flexible backrest body 45 comprises on the rear face 41 a series of five lower slits 48', 48, 49, 50 and 50' made in the nylon fabric on the back of the flexible backrest body 45. A first end of the lower strap 38 is sewed inside the flexible backrest body 45. A second end of the lower strap 38 exits the flexible backrest body 45 through slit 48, and is then passed around the lower end 7 of the side post 6 to form a loop (not shown). The second end of the lower strap 38 successively enters slit 48' and exits slit 50'. The strap 38 is then passed around the lower end 17 of the side post 16, and successively enters slit 50 and exits slit 49. Finally, a Velcro (trademark) fastener provided on the second end of the strap 38 is attached to a complementary Velcro (trademark) fastener 51 fixed on the rear face 41 of the backrest body 45.

Regarding intermediate strap 37, it is passed around both the forwardly bulging sections 32 and 33 of the side posts 6 and 16, and is also passed through loops 52 and 53. For example, the loops 52 and 53 are made of nylon fabric and comprise respective Velcro (trademark) fasteners (not shown) for attaching the loops 52 and 53 to respective, spaced apart vertical Velcro (trademark) strips 200 and 201 mounted, for example sewed to the rear face 41. Accordingly, the loops 52 and 53 are adjustable vertically to retain the strap 37 at the desired vertical position on the side posts 6 and 16 within the range delimited by the strips 200 and 201.

It is also within the scope of the present invention to provide for vertical adjustment of the upper 36 and lower 38 straps.

A set of elongated, vertical pockets 54–57 are formed in the nylon fabric of the rear face 41 to receive respective malleable, substantially stiff metallic stays 58–61 (FIG. 2). In the illustrated example, four pockets and stays are provided; it is however within the scope of the present invention to provide a smaller or larger number of pockets and stays in accordance with the requirements. Also, the stays can be in the form of rectangular plates, elongated bars, rods, or other particular shapes, etc. For example, the stays may be made of aluminium or other metals or materials, including metal alloys or plastics.

Still referring to FIG. 5, the flexible backrest body 45 comprises:

a lower flap 63 padded with a ½ inch thick layer of foam and comprising a Velcro (trademark) fastener 64 for fixation at different possible positions under the seat 66

(FIG. 2) of the wheelchair. The flap 63 is attached under the seat to establish a contact between the user's sacral seat region and the lower portion of the backrest;

a left flap 69 shown in part in FIG. 5 and made of nylon fabric, to be folded over and fixed to the rear face 41 of the backrest body 45 by means of Velcro fasteners mounted, for example sewed on the rear face 41 and the inner face of the flap 69 (only Velcro fastener 68 being shown in FIG. 5); and a right flap 67 shown in part in FIG. 5 and made of nylon fabric, to be folded over and fixed to the outer face of the left flap 69 by means of Velcro fasteners (not shown) fixed on the outer face of the left flap 69 and on the inner face of the right flap 67.

The flaps 67 and 69 ensure both fixation of the layer of foam 38' and nylon fabric envelope 39, and covering and finishing of the rear face 41 of the backrest body 45.

The idea of curving the side posts 6 and 16 originates from the need to induce a depth dimension to the flexible backrest body 45 in order to fit the posterior lateral contour of the user's back and thereby provide lateral support to the user's trunk. More specifically, the side posts 6 and 16 define respective elongated curved front faces from which the flexible backrest body 45 is suspended and adjusted to the posterior lateral contour of the user's back.

Conventionally, the side posts of wheelchairs are straight and serve two main purposes: they support the backrest and enable an assistant to push the wheelchair by means of the handles. By curving (bulging) the side posts 6 and 16 as explained in the foregoing description, the additional purpose of providing lateral support for the user's trunk is implemented. However, curving the side posts 6 and 16 alone is not sufficient to achieve adequate lateral trunk support: it is also essential that the width between the posts 6 and 16 corresponds to the width of the user's trunk. The side posts 6 and 16 of the flexible contour wheelchair backrest are rotatable about their lower end longitudinal geometrical axis whereby the distance separating the forwardly bulging sections 32 and 33 can be reduced or increased to accommodate the width of the user's trunk. As indicated in the foregoing description, the lateral trunk region of the backrest body 45 is padded with a thicker layer of foam (1 inch) so that the side posts 6 and 16 are not felt against the user's trunk to thereby enable the user to seat comfortably.

By adjusting (a) the angular and vertical positions of the side posts 6 and 16 by means of the mechanism of FIG. 3, (b) the length of the upper strap 36, the intermediate strap 37 and the lower strap 38, (c) the vertical position of the intermediate strap 37, and (d) the shape of the stays 58–61, the flexible contour wheelchair backrest is capable of adapting to a great number of users' back contour.

The idea of using stays that can be easily bent into shape originates from the need to reproduce different back shapes on the sagittal plane (from normal geometry to mild kyphosis or light scoliosis). In an advantageous embodiment, each stay is made of aluminum and has a height of 12 inches and a width of ⅝ inch. Their stiffness depends on their thickness; a thickness of 1/16 inch is normally sufficient for stays to support back curves on the sagittal plane and they remain easy to manipulate. This thickness can be modified if different stiffness is needed. Height and width of the stays can be also modified for better accommodation.

Since back curves are not given enough support with stays alone, the additional support is provided by the three adjustable upper 36, intermediate 37 and lower 38 straps. The combination of stays and straps and curved side posts allows for better adjustment of the shape of the flexible contour backrest body to fit the posterior and posterior lateral shape of the user's back. Furthermore, by increasing the contact surface the stays enable even distribution of pressure through the flexible contour backrest.

Figure 6:
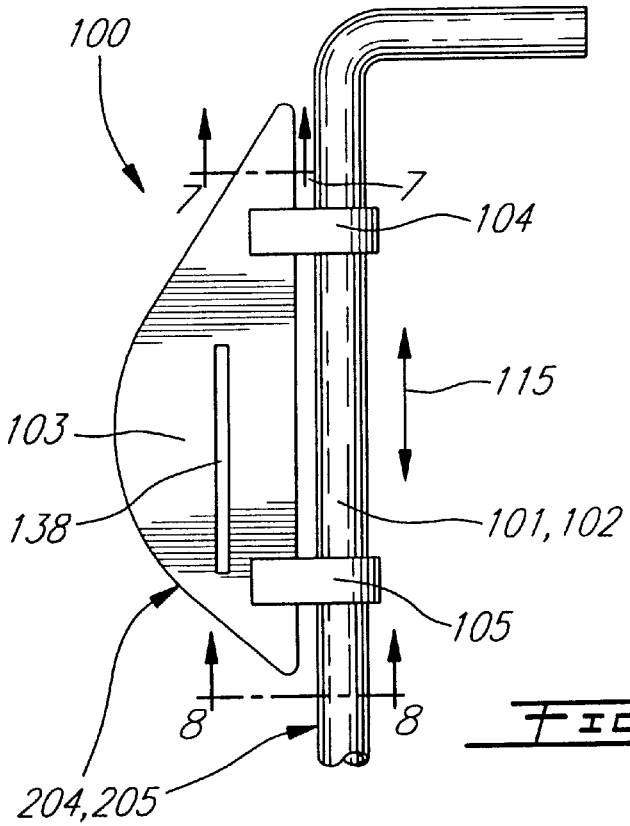
FIG. 6 is a side elevational view of the side posts of a second embodiment of the flexible contour backrest according to the invention.
Figure 7:
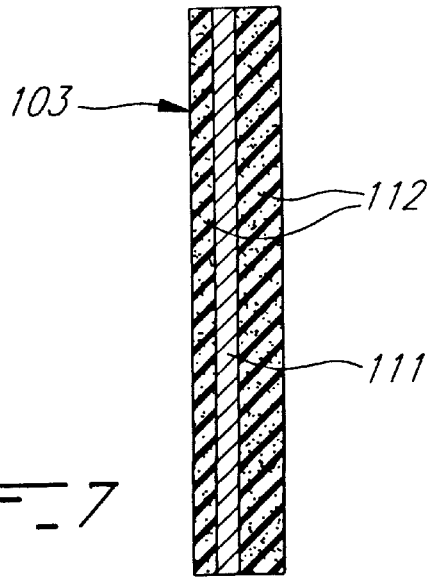
FIG. 7 is a cross sectional view of a contour member of the side post of FIG. 6, taken along line 7—7 of FIG. 6.

FIGS. 6–9 illustrate a second preferred embodiment 100 of the flexible contour backrest according to the invention. Referring to FIG. 6, the flexible contour backrest 100 uses the either vertical or slightly rearwardly inclined side posts 101 and 102 (hereinafter referred to as tubular members 101 and 102) of conventional wheelchairs (FIGS. 6, 8 and 9). The upper end of the tubular members 101 and 102 are usually bent rearwardly to form conventional wheelchair handles 118 and 119.

In accordance with the second preferred embodiment of the present invention, a contour member 103 having a suitable profile (a possible profile being shown in FIG. 6) is mounted to each tubular member 101 and 102 through a pair of specially designed fasteners 104 and 105 to form side posts 204 and 205 with respective elongated curved front faces. As illustrated in FIG. 8, each fastener 104, 105 comprises a split sleeve member 106 tightened on the tubular member 101, 102 by means of a screw 107 interconnecting two end ears 108 and 109 of the split sleeve member 106. As also shown in FIG. 8, one 108 of the two end ears comprises a flat bar extension 110.

The contour member 103 comprises an inner rigid core plate 111 (FIGS. 7 and 8) of, for example, aluminium material. Other materials can be used to fabricate the inner rigid core plate 111. A layer of padding foam material 112 (FIG. 7) is applied to each face of the inner rigid core plate for the user's comfort. As illustrated in FIG. 8, the rigid plate 111 is fixed to the flat bar extensions 110 of the two fasteners 104 and 105 by means of rivets, nut-and-screw assemblies, etc. (see 113 and 114).

Therefore, by loosening the screws 107 and therefore the split sleeve members 106 of the two fasteners 104 and 105, the split sleeve members 106 and accordingly the contour member 103 can be raised or lowered on the tubular member 101, 102 (see arrows 115 in FIG. 6). In the same manner, the split sleeve members 106 and accordingly the contour member 103 can be rotated about the tubular member 101, 102 (see arrows 116 in FIG. 8). Therefore, the position of the contour member 103 can be adjusted as required to adapt the morphology and anthropometry of the user's back as well as to accommodate the width of the user's trunk.

An advantage of the embodiment of FIGS. 6–9 is that it requires no modification of the existing side posts (tubular members 101 and 102) of conventional wheelchairs.

The flexible contour backrest 100 further comprises a flexible backrest body 124 extending between the two side posts 204 and 205.

Referring to FIG. 9, the backrest body 124 comprises a layer of foam (not shown) covered by an envelope of nylon fabric. In a preferred embodiment, the layer of foam is 1 inch thick. FIG. 9 shows the rear layer of nylon fabric forming a rear face 125 of the flexible backrest body 124.

The flexible backrest body 124 further comprises an upper strap 117 extending between the upper ends of the side posts 204 and 205 with respective elongated curved front faces, below the handles 118 and 119. The flexible backrest body 124 further comprises an intermediate strap 120 and a lower strap 121. The lower strap 121 extends between the lower ends 122 and 123 of the side posts 204 and 205 with respective elongated curved front faces. Regarding the intermediate strap 120, it extends between the central forwardly bulging sections of the contour members 103 of the two side posts 204 and 205.

Still referring to FIG. 9, the nylon fabric comprises on the rear face 125 a series of five upper slits, including slits 126, 127 and 128, made in the nylon fabric on the back of the flexible backrest body 124. A first end of the upper strap 117 is sewed inside the flexible backrest body 124. A second end of the upper strap 117 exits the flexible backrest body 124 through slit 128, and is then passed around the upper end of the tubular member 102, below the handle 119, to form a loop 129. Tubular member 102 is provided with a strap holding element 130 to prevent the loop 129 from sliding downwardly on that tubular member 102, and thereby hold the flexible backrest body 124 in stable vertical position on the side post 204.

The second end of the upper strap 117 successively enters the upper slit (not shown) situated farther to the right, and exits the upper slit (not shown) situated farther to the left. The upper strap 117 is then passed around the upper end of tubular member 101, and then successively enters slit 126 and exits slit 127. Finally, a Velcro (trademark) fastener provided on the second end of the strap 117 is attached to a complementary Velcro (trademark) fastener 131 fixed on the rear face 125 of the backrest body 124. Again, tubular member 101 is provided with a strap holding element 132 to prevent the upper strap 117 from sliding downwardly on that tubular member 101, and thereby hold the backrest body 124 in stable vertical position on the side post 205.

As also illustrated in FIG. 9 of the appended drawings, the flexible backrest body 124 comprises on the rear face 125 a series of five lower slits including slits 133, 134 and 135 made in the nylon fabric on the back of the flexible backrest body 124. A first end of the lower strap 121 is sewed inside the flexible backrest body 124. A second end of the lower strap 121 exits the flexible backrest body 124 through slit 135, and is then passed around the lower end 123 of the tubular member 102 to form a loop 136. The second end of the lower strap 121 successively enters the lower slit (not shown) situated farther to the right, and exits the lower slit (not shown) situated farther to the left. The strap 121 is then passed around the lower end 122 of the tubular member 101, and successively enters slit 133 and exits slit 134. Finally, a Velcro (trademark) fastener provided on the second end of the strap 121 is attached to a complementary Velcro (trademark) fastener 137 fixed on the rear face 125 of the backrest body 124.

Regarding intermediate strap 120, it forms a loop comprising two ends sections 139 and 140 respectively inserted in slots such as 138 of the contour members 103 of the two side posts 204 and 205. To complete the loop, the two end sections 139 and 140 are attached together by means of complementary Velcro fasteners. The intermediate strap 120 passes through loops 141 and 142. For example, the loops 141 and 142 are made of nylon fabric and comprise respective Velcro (trademark) fasteners (not shown) for attaching the loops 141 and 142 to respective, spaced apart vertical Velcro (trademark) strips 143 and 144 mounted, for example sewed to the rear face 125. Accordingly, the loops 141 and 142 are adjustable vertically to retain the intermediate strap 120 at the desired vertical position within the range delimited by the strips 143 and 144 and the length of the slots 138.

Two elongated, vertical and laterally adjacent pockets 145 and 146 are formed in the nylon fabric of the rear face 125 to receive respective stays 147 and 148. In the illustrated example, two pockets and stays are provided; it is however within the scope of the present invention to provide a smaller or larger number of pockets and stays in accordance with the requirements of an intended application. Also, the stays can be in the form of rectangular plates, elongated bars, rods, or other shapes, etc. They can be made of metallic material such as aluminum and any other metal or material, including metal alloys and plastics.

Still referring to FIG. 9, the flexible backrest body 124 comprises:

- a lower flap 149 padded with a 1 inch thick layer of foam and comprising a Velcro (trademark) fastener (not shown) for fixation at different possible positions under the seat 66 (FIG. 2). The flap 149 is attached under the seat to establish a contact between the user's sacral seat region and the lower portion of the backrest;
- a left flap 151 made of nylon fabric, to be folded over and fixed to the rear face 125 of the backrest body 124 by means of Velcro fasteners (not shown) fixed on both the rear face 125 and the inner face of flap 151; and
- a right flap 150 made of nylon fabric, to be folded over and fixed to the outer face of the left flap 151 by means of Velcro fasteners (not shown) fixed on the outer face of the left flap 151 and on the inner face of the flap 150.

The flaps 150 and 151 ensure both fixation of the layer of foam and nylon fabric envelope to the two side posts 204 and 205, and covering and finishing of the rear face 125 of the backrest body 124.

The idea of providing the tubular members 101 and 102 with contour members 103 originates from the need to induce a depth dimension to the flexible backrest body 124 in order to fit the posterior lateral contour of the user's back and thereby provide lateral support to the user's trunk. More specifically, the contour members 103 define respective elongated curved front face from which the flexible backrest body 124 is suspended and adjusted to the posterior and posterior lateral contour of the user's back.

Conventionally, the side posts of wheelchairs are straight and serve two main purposes: they support the backrest and enable an assistant to push the wheelchair by means of the handles. By providing the contour members 103 as explained in the foregoing description, the additional purpose of providing support for the user's trunk is implemented. However, providing the contour members 103 alone is not sufficient to achieve adequate lateral trunk support; it is also essential that the width between the contour members 103 corresponds to the width of the user's trunk. Since the two contour members 103 are rotatable about the tubular members 101 and 102, respectively, the distance separating the forwardly bulging sections of the contour members 103 can be reduced or increased to accommodate the width of the user's trunk. Since the contour members 103 and the flexible backrest body 124 are padded with foam material, they are not felt against the user's back to thereby allow the user to seat comfortably.

By adjusting (a) the angular and vertical positions of the contour members 103 (see arrows 115 of FIG. 6 and arrows 116 of FIG. 8), (b) the length of the upper strap 117, intermediate strap 120 and lower strap 121, (c) the vertical position of the intermediate strap 120, and (d) the shape of the stays 147 and 148, the flexible contour wheelchair backrest is capable of adapting to a great number of user's back shapes.

The idea of using stays that can be easily bent into shape originates from the need to reproduce different back shapes on the sagittal plane (from normal geometry to mild kyphosis or light scoliosis). In an advantageous embodiment, each stay has a height of 12 inches and a width of 4 inches. Their stiffness depends on their thickness; a thickness of 1/16 inch is normally sufficient for stays to support back curves on the sagittal plane and they remain easy to manipulate. This thickness can be modified if different stiffness is needed.

Since back curves are not given enough support with stays alone, the additional support is provided by the three adjustable upper strap 117, intermediate strap 120 and lower strap 121. The combination of stays and straps, and contour members allows for better adjustment of the shape of the flexible contour backrest body to fit the posterior and posterior lateral shape of the user's back. Furthermore, by increasing the contact surface the stays distribute evenly the pressure through the flexible contour wheelchair backrest.

Although substantially stiff and malleable stays 58, 59, 60, 61, 147 and 148 have been described in the foregoing description, these stays can also be pre-formed elements.

It should also be mentioned that the flexible contour backrest according to the present invention is sufficiently flexible to cause no interference upon folding of a wheelchair.

Moreover, the flexible contour backrest according to the invention can be modified to enable adjustment of the divergence and convergence of the side posts with elongated curved front faces.

Finally, the substantially straight lower ends 7, 17 may remain rotatable on the upper ends 8, 18, or the contour members 103 may remain rotatable on the tubular member 101 and 102 to enable automatic adjustment of the width between the forwardly bulging sections 32 and 33 or the contour members 103 to the width of the user's trunk when the user sits in the wheel chair.

Although the present invention has been described hereinabove by way of preferred embodiments thereof, these embodiments can be modified at will, within the scope of the appended claims, without departing from the spirit and nature of the subject invention.

What is claimed is:

1. A flexible contour backrest comprising:

two side posts;

a flexible backrest body extending between the two side posts, and comprising:

a plurality of transversally extending and vertically spaced apart flexible straps each interconnecting said two side posts, each flexible strap having a length-adjusting system and a length adjustable through said length-adjusting system; and a plurality of stays intersecting at least one of said flexible straps, wherein each stay is made of substantially stiff but malleable material;

wherein, in operation, the contour of the backrest body can be adjusted to the contour of a user's back by adjusting the length of the straps and the shape of the stays.

2. A flexible contour backrest as recited in claim 1, wherein the flexible backrest body comprises pockets in which the stays are positioned.

3. A flexible contour backrest as recited in claim 1, wherein said plurality of transversally extending and vertically spaced apart flexible straps comprises:

an upper strap;

a lower strap; and an intermediate strap situated between the upper and lower straps.

4. A flexible contour backrest as recited in claim 3, further comprising a strap vertical position adjusting system through which a vertical position of at least the intermediate strap on the two side posts is adjusted.

5. A flexible contour backrest as recited in claim 1, wherein said transversally extending and vertically spaced apart flexible straps are generally perpendicular to the two side posts, and wherein said stays are generally perpendicular to said flexible straps.

6. A flexible contour backrest comprising:

two side posts; and a flexible backrest body extending between the two side posts and including two opposite sides attached to the two side posts, respectively;

wherein each side post comprises an elongated curved front face;

the two opposite sides of the flexible backrest body are applied to and suspended from the elongated curved front faces of the two side posts, respectively;

said elongated curved front face of each side post defines a forwardly bulging section inducing a depth dimension to the flexible backrest body;

the flexible contour backrest further comprises, for each side post, a bulging sections inter-distance adjusting mechanism through which the distance between the forwardly bulging sections of the elongated curved front faces of the two side posts is adjusted;

the two side posts each comprise an elongated member and a contour member mounted on the elongated member to define the elongated curved front face of the side post, wherein said contour member is mounted on said elongated member through a rotating mechanism forming said bulging sections inter-distance adjustment mechanism.

7. A flexible contour backrest as recited in claim 6, wherein said bulging sections inter-distance adjusting mechanism further comprises means for locking said contour member in a plurality of different angular positions about said elongated member, said locking means comprising a releasable mechanical connection between the contour member and the elongated member.

8. A flexible contour backrest as recited in claim 6, wherein said bulging sections inter-distance adjusting mechanism further comprises means for moving the contour member longitudinally on the elongated member, and means for locking the contour member in a plurality of different positions along the elongated member, said longitudinally moving means and said locking means comprising a releasable mechanical connection between the contour member and the elongated member.

9. A flexible contour backrest as recited in claim 6, wherein said contour member comprises a rigid core plate and a padding layer enveloping said rigid core plate.

10. A flexible contour backrest comprising:

two side posts; and a flexible backrest body extending between the two side posts and including two opposite sides attached to the two side posts, respectively;

wherein:

each side post comprises an elongated curved front face;

the two opposite sides of the flexible backrest body are applied to and suspended from the elongated curved front faces of the two side posts, respectively;

said elongated curved front face of each side post defines a forwardly bulging section inducing a depth dimension to the flexible backrest body;

the flexible contour backrest further comprises, for each side post, a bulging sections inter-distance adjusting mechanism through which the distance between the forwardly bulging sections of the elongated curved front faces of the two side posts is adjusted;

the two side posts each comprise a curved elongated member having a substantially straight lower end mounted to a chair frame, said substantially straight lower end having a longitudinal geometrical axis; and the bulging sections inter-distance adjusting mechanism comprises a rotating mechanism interposed between the substantially straight lower end of the curved elongated member and the chair frame, said rotating mechanism having a rotation axis corresponding to said longitudinal geometrical axis.

11. A flexible contour backrest as recited in claim 10, wherein said bulging sections inter-distance adjusting mechanism further comprises means for locking the substantially straight lower end of the curved elongated member on the chair frame in a plurality of different angular positions about said longitudinal geometrical axis, wherein said locking means comprises a releasable mechanical connection between the substantially straight lower end of the curved elongated member and the chair frame.

12. A flexible contour backrest as recited in claim 10, wherein the bulging sections inter-distance adjusting mechanism further comprises an axially moving connection between the substantially straight lower end of the curved elongated member and the chair frame and means for locking the substantially straight lower end of the curved elongated member on the chair frame in a plurality of different axial positions, wherein said locking means comprises a releasable mechanical connection between the substantially straight lower end of the curved elongated member and the chair frame.

13. A flexible contour backrest comprising:

two side posts each comprising an elongated curved front face;

a flexible backrest body extending between the elongated curved front faces of the two side posts, and comprising:

a plurality of transversally extending and vertically spaced apart flexible straps each interconnecting said two side posts with elongated curved front faces, each flexible strap having a length-adjusting system and a length adjustable through said length-adjusting system; and a plurality of substantially stiff stays intersecting at least one of said flexible straps.

14. A flexible contour backrest as recited in claim 13, wherein the substantially stiff stays are malleable whereby, in operation, the contour of the flexible backrest body can be adjusted to the contour of a user's back by adjusting (a) the length of the straps and (b) the shape of the stays.

15. A flexible contour backrest as recited in claim 13, wherein said plurality of transversally extending and vertically spaced apart flexible straps comprises:

an upper strap;

a lower strap; and an intermediate strap situated between the upper and lower straps.

16. A flexible contour backrest as recited in claim 15, further comprising a strap vertical position adjusting system through which a vertical position of at least the intermediate strap on the two side posts is adjusted whereby, in operation, the contour of the backrest body can be adjusted to the contour of a user's back by adjusting (a) the vertical position of the intermediate strap on the two side posts and (b) the length of the upper, intermediate and lower straps.

17. A flexible contour backrest as recited in claim 13, wherein said transversally extending and vertically spaced apart flexible straps are generally perpendicular to the two side posts, and wherein said substantially stiff stays are generally perpendicular to said straps.

18. A flexible contour backrest as recited in claim 13, wherein the flexible backrest body comprises pockets in which the substantially stiff stays are positioned.

19. A flexible contour backrest as recited in claim 13, wherein the two side posts are mounted on a chair frame, and wherein said flexible contour backrest further comprises, for each side post, a post vertical position adjusting mechanism through which a vertical position of the side post on the chair frame is adjusted whereby, in operation, the contour of the backrest body can be adapted to the contour of a user's back by adjusting (a) the vertical position of the two side posts on the chair frame and (b) the length of the straps.

20. A flexible contour backrest as recited in claim 13, wherein the elongated curved front face of each side post has a forwardly bulging section forming a lateral support for a user's trunk.

21. A flexible contour backrest as recited in claim 20, further comprising a bulging sections inter-distance adjusting mechanism through which the distance between the forwardly bulging sections of the elongated curved front faces of the two side posts is adjusted in order to adapt the distance between said forwardly bulging sections to the width of the user's trunk.

22. A flexible contour backrest as recited in claim 21, wherein the two side posts each comprise:

a curved elongated member having a substantially straight lower end mounted to a chair frame, said substantially straight lower end having a longitudinal geometrical axis; and wherein said bulging sections inter-distance adjusting mechanism comprises:

a rotating mechanism interposed between the substantially straight lower end of the curved elongated member and the chair frame, said rotating mechanism having a rotation axis corresponding to said longitudinal geometrical axis.

23. A flexible contour backrest as recited in claim 22, wherein said bulging sections inter-distance adjusting mechanism further comprises means for locking the substantially straight lower end of the curved elongated member on the chair frame in a plurality of different angular positions about said longitudinal geometrical axis, wherein said locking means comprises a releasable mechanical connection between the substantially straight lower end of the curved elongated member and the chair frame.

24. A flexible contour backrest as recited in claim 22, wherein the bulging sections inter-distance adjusting mechanism further comprises an axially moving connection between the substantially straight lower end of the curved elongated member and the chair frame and means for locking the substantially straight lower end of the curved elongated member on the chair frame in a plurality of different axial positions whereby, in operation, the contour of the backrest body can be adjusted to the contour of a user's back by adjusting (a) the distance between said forwardly bulging sections, (b) the length of the straps and (c) the axial position of the substantially straight lower end of the curved elongated members about the chair frame wherein said locking means comprises a releasable mechanical connection between the substantially straight lower end of the curved elongated member and the chair frame.

25. A flexible contour backrest as recited in claim 21, wherein the two side posts each comprise an elongated member and a contour member mounted on the elongated member to define the elongated curved front face of the side post, wherein said said contour member is mounted on said elongated member through a rotating mechanism forming said bulging sections inter-distance adjusting mechanism.

26. A flexible contour backrest as recited in claim 25, wherein said bulging sections inter-distance adjusting mechanism further comprises means for locking said contour member in a plurality of different angular positions about said elongated member, said locking means comprising a releasable mechanical connection between the contour member and the elongated member.

27. A flexible contour backrest as recited in claim 25, wherein said bulging sections inter-distance adjusting mechanism further comprises means for moving the contour member longitudinally on the elongated member, and means for locking the contour member in a plurality of different positions along the elongated member whereby, in operation, the contour of the backrest body can be adapted to the contour of a user's back by adjusting (a) the angular position of the contour member about the elongated member, (b) the length of the straps and (c) the position of the contour member along the elongated member, wherein said longitudinally moving means and said locking means comprises a releasable mechanical connection between the contour member and the elongated member.

28. A flexible contour backrest as recited in claim 25, wherein said contour member comprises:

a rigid core plate; and a padding layer enveloping said rigid core plate.

29. A flexible contour backrest comprising:

two side posts;

a flexible backrest body extending between the two side posts, and comprising:

a plurality of transversally extending and vertically spaced apart flexible straps each interconnecting said two side posts, each strap having a given length; and a plurality of substantially stiff stays intersecting at least one of said flexible straps and shaped to fit the contour of a user's back;

wherein the contour of the backrest body is adjusted to the contour of a user's back through the length of the straps and the shape of the stays.

* * * * *